United States Patent [19]

Sieber

[11] 4,110,757

[45] Aug. 29, 1978

[54] BRACKET ASSEMBLY FOR MOUNTING A CB ANTENNA

[75] Inventor: Felix P. Sieber, Union, N.J.

[73] Assignee: BCS Mach. & Mfg. Corp., South Plainfield, N.J.

[21] Appl. No.: 749,661

[22] Filed: Dec. 13, 1976

[51] Int. Cl.[2] ..... H01Q 1/32

[52] U.S. Cl. ..... 343/715; 343/713

[58] Field of Search ..... 343/713, 715

[56] References Cited

U.S. PATENT DOCUMENTS

| | | | |
|---|---|---|---|
| 4,028,705 | 6/1977 | Loyd | 343/715 |
| 4,035,806 | 7/1977 | Powell | 343/715 |

OTHER PUBLICATIONS

*Stowit, S9*, p. 144, Aug.' 76, Cowan Publishing Corp, L.I., N.Y., 11050.

*Disappearing Antenna Mount, CB World*, Sep.' 76, CB World Magazine Corp, 717 5th Ave., N.Y., N.Y. 10022.

*Primary Examiner*—Alfred E. Smith
*Assistant Examiner*—Harry E. Barlow

[57] ABSTRACT

A bracket assembly for mounting a citizen band (CB) antenna on the hinge bolt of an automobile trunk lid is disclosed. When the trunk lid is closed, only the antenna and one end portion of the bracket assembly is outside of the trunk compartment. In order to completely conceal the antenna without disassembling the bracket assembly from the hinge bolt the trunk lid is lifted and the bracket assembly is pivoted about a first axis and then about a second axis that is preferably perpendicular to the first axis. In this manner the entire bracket assembly as well as the antenna mounted thereon may be stowed and completely concealed within the trunk compartment without disassembling the bracket assembly from the hinge bolt.

14 Claims, 6 Drawing Figures

FIG. 1
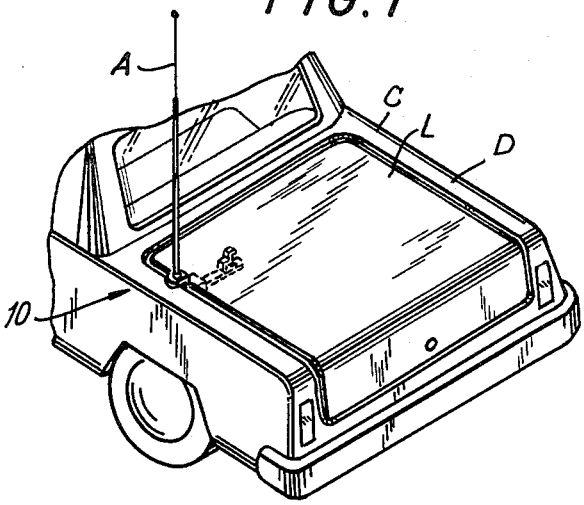
FIG. 2
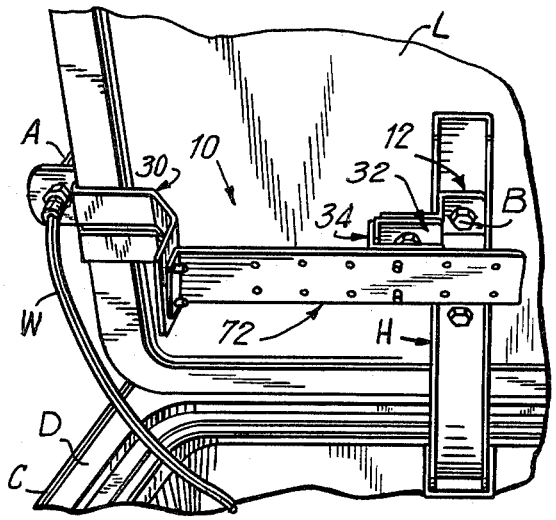
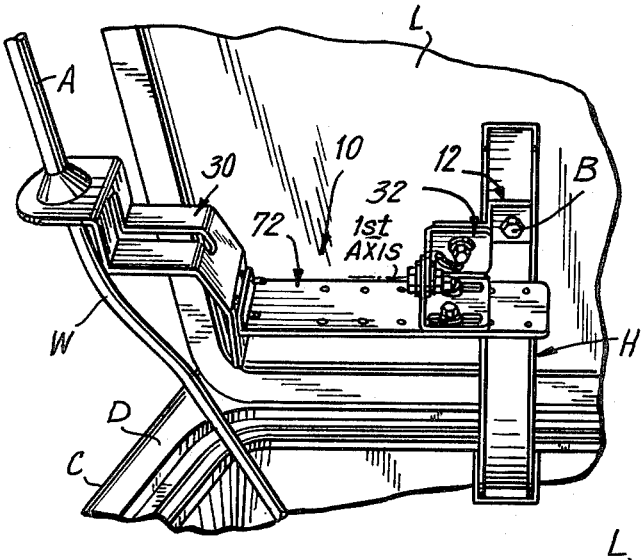
FIG. 3
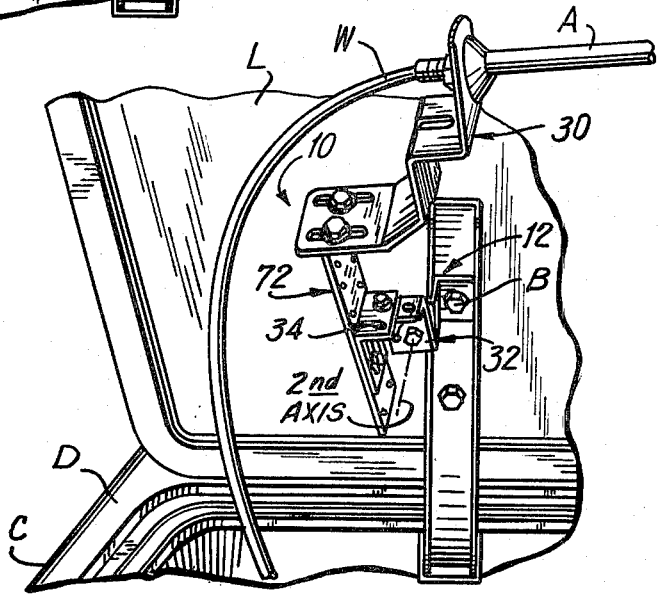
FIG. 4

BRACKET ASSEMBLY FOR MOUNTING A CB ANTENNA

BACKGROUND OF THE INVENTION

1. Field of the Invention

This invention relates generally to antenna mounting means for an automobile and more particularly to improved means for mounting a CB antenna utilizing the hinge bolt of a trunk lid of an automobile.

2. Description of the Prior Art

CB antennas are currently becoming more and more popular and are now quite commonplace in automobiles that are used primarily for pleasure driving. The antenna is externally mounted on the automobile with the remaining components being conveniently positioned internally of the automobile and with suitable electrical connection therebetween. While brackets for mounting the antenna of a CB radio are presently available, little thought has been given to the best type of mounting means therefor. Some brackets for mounting a CB antenna fit the automobiles made by a limited number of manufacturers and are therefore not universal. Where the antenna bracket is adaptable to a wide variety of automobiles, it is frequently necessary to drill the body of the automobile in order to mount the antenna. It will be evident that drilling holes in the body of a car is undesirable in that it requires special skills and special tools and is therefore expensive if it must be done by a specialist. Moreover, the drilling of holes in an automobile can be unsightly, particularly if a mistake is made. It will be appreciated that when holes are drilled in an automobile, there is a likelihood of rusting where the primer or protective coating is removed. And, in addition, holes drilled in an automobile provide a convenient pathway for water. This is particularly disadvantageous where the holes are drilled in the trunk lid.

Another shortcoming in the prior art CB antenna mounting means resides in the fact that at least a portion of the antenna mount is always visible. The presence of the antenna mount is an invitation to vandalism since it is quite evident that an expensive electronic device is contained within the automobile. There have been many instances of theft of the CB radio with an attendant damage to the automobile and inconvenience and expense to the owner.

SUMMARY OF THE INVENTION

The present invention provides an improved CB antenna mounting assembly that may be secured to the hinge bolt of the trunk lid of the automobile in such a manner that when in use, the antenna and only a portion of the mounting assembly are exposed. The present invention provides means for completely concealing both the antenna and the mounting assembly therefore within the trunk compartment of an automobile without disassembling the mounting assembly from the hinge bolt of the trunk lid. The present invention does not require any drilling of the automobile body so that no holes are produced which can cause leakage of rainwater into the trunk. Thus, the present invention does not require any special tools or special skills for the assembly thereof.

In its broadest aspect the present invention provides a first bracket having an opening therein for receiving the bolt that secures the hinge to the trunk lid. A second bracket to which the CB antenna is mounted is secured to the first bracket by a pivotal joint means that comprises third and fourth brackets. The third bracket is coupled to the first bracket for pivotal movement about a first axis and the fourth bracket is coupled to the third bracket for pivotal movement about a second axis. The second bracket on which the CB antenna is mounted is coupled to the fourth bracket. The first and second axes mentioned above are, preferably, perpendicular to each other.

Means are also included for mounting the bracket assembly comprising the present invention on either side of the trunk lid without sacrificing any movement during the stowing operation thereof. That is, the bracket assembly may be mounted on either the drivers side or on the opposite side. Moreover, means are provided that make the bracket assembly of the present invention adaptable to virtually all automobiles presently being manufactured. That is, in some automobiles the bolt that secures the hinge assembly may be in a vertical plane or may be in a horizontal plane. The first bracket of the present invention may be used with either arrangement. Spacer means which are both adjustable and variable are also included so as to accommodate virtually any width automobile.

Accordingly, it is an object of the present invention to provide an improved bracket assembly for mounting a CB antenna to the trunk lid of an automobile.

It is another object of the present invention to provide an improved bracket assembly, as described above, that is completely concealed within the trunk compartment of an automobile when not in use.

A further object of the present invention is to provide an improved bracket assembly for a CB antenna, as described above, that does not require any drilling or other alteration of an automobile and does not require any special skills or tools for the mounting thereof.

An additional object of the present invention is to provide an improved bracket assembly for mounting a CB antenna on an automobile, as described above, wherein the bracket assembly is universal and is adaptable to all makes and models of automobiles.

A specific object of the present invention is to provide an improved bracket assembly for mounting a CB antenna on an automobile wherein the bracket assembly includes joint means such that the bracket assembly may be folded on itself and completely stowed within the trunk compartment of an automobile when desired by the owner without disassembling the bracket assembly from the automobile.

These and other objects, features and advantages of the invention will, in part, be pointed out with particularity and will, in part, become obvious from the following more detailed description of the invention, taken in conjunction with the accompanying drawings which forms an integral part thereof.

BRIEF DESCRIPTION OF THE DRAWINGS

In the various figures of the drawing, like reference characters designate like parts.

In the drawing:

FIG. 1 is a rear perspective view of one embodiment of the present invention mounted on an automobile with the trunk lid shown in the closed position;

FIG. 2 is a rear elevational view, similar to FIG. 1 but with the trunk lid shown in the open position;

FIG. 3 is a rear elevational view, similar to FIG. 2, illustrating a portion of the bracket assembly comprising the present invention after it has been pivoted about a first axis;

FIG. 4 is a rear elevational view similar to FIG. 3 but illustrating the bracket assembly pivoted about a second axis;

DESCRIPTION OF THE PREFERRED EMBODIMENTS

Referring first to FIGS. 1–4 it will be seen that the bracket assembly 10 comprising the present invention is mounted on the bolt B of the hinge assembly H of an automobile C. As shown best in FIG. 1 a portion of the bracket assembly 10 comprising the present invention is intended to pass through the very small gap that normally exists between the trunk lid L and the rear deck D of the automobile C. Because of manufacturing tolerances and other considerations, this gap normally occurs and is usually taken up by some resilient sealing material. The present invention does not interfere with the sealing material because it is made of relatively thin metal which, however, is sufficiently rigid so as to prevent distortion.

As will be explained more fully hereinafter, the bracket assembly 10 comprising the present invention together with the CB antenna mounted thereon, may be completely stowed within the trunk compartment of the automobile C without removing the bolt B. As shown in FIG. 3, for example, the bracket assembly 10 is pivoted about a first axis. In order to completely stow the bracket assembly 10, it is then pivoted about a second axis as shown in FIG. 4. This will result in locating the entire bracket assembly 10 as well as the antenna A within the trunk compartment.

Figure 5:
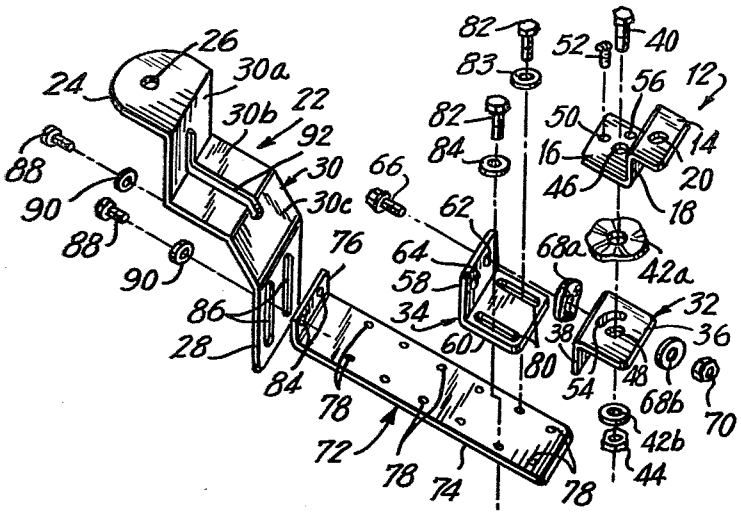
FIG. 5 is an exploded, perspective view illustrating the components of a first embodiment of the present invention.

Turning now to FIG. 5, there are shown the components of the antenna bracket assembly 10 comprising the present invention. The assembly 10 comprises a first bracket 12 that is Z-shaped. The first bracket 12 includes a first leg 14, a second leg 16 that is parallel to but spaced from the first leg 14 and a connecting leg 18. The first leg 14 is provided with an opening 20. In order to assemble the bracket 12 to the automobile C the hinge bolt B is removed and is passed through the opening 20. It will be noted that in this first embodiment, the hinge bolt B is in a vertical plane. For this reason, the plane of the first leg 14 and the axis of the opening 20 are in horizontal and vertical planes, respectively.

A second bracket 22 comprising the present invention is also provided with a first leg 24 having an opening 26 therethrough and a second leg 28, the function of which will be described hereinafter. A leg 30 connects the first and second legs 24 and 28, respectively. The opening 26 in the first leg 24 is used for mounting the antenna A thereon utilizing conventional hardware.

Joint means are used for coupling the first and second brackets 12 and 22, respectively, to each other. The joint means are comprised of a third bracket 32 and a fourth bracket 35. The third bracket 32 is L-shaped and includes a first leg 36 and a second leg 38. Pivotal connection between the first bracket 12 and the third bracket 32 is provided by means of a screw 40, washers **42*a*, 42*b* and a nut 44 with the screw 40 passing through aligned openings 46 and 48 in the second leg 16 of the first bracket 12 and the first leg 36 of the second bracket 32**.

In order to limit the angular movement of the first and third brackets, 12 and 32, respectively, with respect to each other, the second leg 16 of the first bracket 12 is provided with a first opening 50 for receiving a stop pin 52 while the first leg 36 of the third bracket 32 is provided with an arcuate slot 54 that is in alignment with the axis of the opening 50 and the stop pin 52. The radius of the arcuate slot 54 is concentric with the axis of the opening 48 in the first leg 36 of the third bracket 32. Conveniently the opening 50 in the second leg 16 of the first bracket 12 may be threaded and the stop pin 52 may be in the form of a screw. In order to permit the assembly 10 to be mounted on either side of the automobile C, that is, to utilize either of the hinge assemblies H, a second opening 56 is provided in the second leg 16 of the first bracket 12. Depending upon which side the bracket assembly 10 is to be mounted, the stop pin 52 is inserted in either of the openings 50 or 56 in the second leg 16 of the first bracket 12. Conveniently, the opening 56 would also be threaded.

The fourth bracket 34 is L-shaped and is comprised of a first leg 58 and a second leg 60. The first leg 58 is provided with two openings 62 and 64 in order to receive pivot means in the form of a screw 66, washers **68*a*, 68*b* and a nut 70. Although they are not visible in FIG. 5 the third bracket 32 is provided with two openings which are aligned with the openings 62 and 64 in the first leg 58 of the fourth bracket 34. Thus, the screw 66 may be positioned in either of the openings 62 or 64 and the opening in the leg 38 of the third bracket 32 that is aligned therewith and thereby permit mounting of the bracket assembly 10** on either side of the automobile.

In order to permit the bracket assembly 10 comprising the present invention to be mounted in a wide range of automobiles, a spacer 72 is provided. The spacer 72 is an elongated L-shaped strap having a first leg 74 and a second leg 76. The first leg includes a plurality of pairs of threaded openings 78 spaced therealong. The second leg 60 of the fourth bracket 34 is provided with a pair of cooperating, elongated slots 80 so that, by means of screws 82 and washers 83, the fourth bracket 34 may be adjustably positioned at any one of a number of different locations on the first leg 74 of the spacer means 72. In order to couple the second bracket 22 to the spacer 72 a pair of openings 84 are provided in the second leg 76 of the spacer 72. These openings cooperate with a pair of aligned, elongated slots 86 formed in the second leg 28 of the second bracket 22. The second bracket 22 and the spacer 72 are secured to each other by means of screws 88 and washers 90. It should be noted at this time that the second bracket 22 may be made in various configurations so as to accommodate a wide range of different automobile models. Thus, the connecting leg 30 may be made in several sections **30*a*, 30*b* and 30*c*, each of which are at some preselected angle with respect to each other. Conveniently, a slot 92 may be formed in the connecting leg 30** so that the antenna wire W may pass therethrough.

Figure 6:
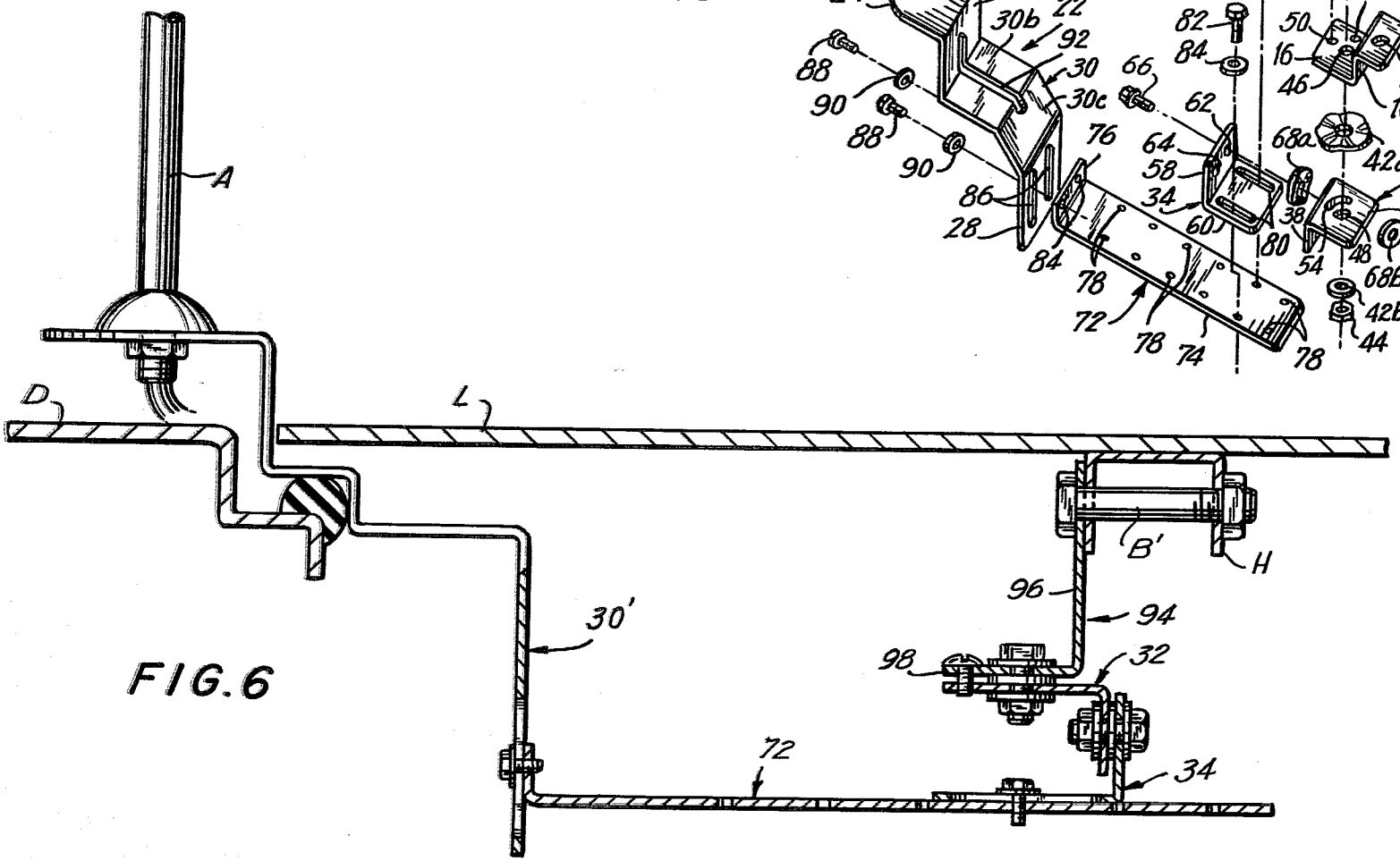
FIG. 6 is a side elevational view, partially broken away, of an alternative embodiment of the present invention.

The second embodiment of the present invention is shown in FIG. 6. This second embodiment is substantially the same as the first embodiment except that the first bracket 94 is adapted to be mounted on a horizontally oriented hinge bolt B′ whereas in the first embodiment the hinge bolt B is vertically oriented. All of the remaining structure is substantially the same. That is, the joint means comprised of the third bracket 32 and the fourth bracket 34 in the second embodiment is also arranged to pivot about two mutually perpendicular axes, as is the first embodiment. The first bracket 94 is L-shaped having a flat and vertically oriented first end 96 through which the hinge bolt B′ passes and a second end 98 that is in a plane substantially perpendicular to the plane of the first end 96. The second bracket 30′ is shown in a slightly modified form to illustrate the adaptability of the present invention to a wide variety of automobile designs. The spacer 72 shown in the first embodiment may also be used, if required.

From the foregoing it will be evident that an improved bracket assembly for mounting a CB antenna on the hinge bolt of a trunk lid of an automobile has been provided. In one embodiment of the present invention a Z-shaped bracket is provided where the hinge bolt is in a vertical plane and, in an alternative embodiment of the present invention a flat bracket is provided where the hinge bolt is in a horizontal plane. In both embodiments joint means are utilized so that the bracket asembly may be folded on itself and completely stowed within the trunk compartment of the automobile so that it is not externally visible and without the necessity of removing the bracket assembly from the hinge bolt. It will be evident that no special skills or tools are required in order to mount the bracket assembly comprising the present invention on an automobile and, in addition, it will also be evident that it is not necessary to drill any holes in the automobile itself in order to mount the bracket assembly. The present invention may be mounted on either side of the automobile and is therefore adaptable to a wide range of models. When in use, only a small portion of the bracket comprising the present invention extends through the gap between the trunk lid and the trunk deck. When not in use the entire bracket assembly including the antenna mounted thereon is totally concealed and contained within the trunk compartment of the automobile.

There have been disclosed heretofore the best embodiments of the invention presently contemplated. It is to be understood however that various changes and modification may be made thereto by those skilled in the art without departing from the spirit of the invention.

What I claim as new and desire to secure by Letters Patent is:

1. An assembly for mounting a CB antenna to a bolt that is used for securing a hinge to a trunk lid of an automobile, said assembly comprising:

(a) a first bracket having a single opening therein for receiving the bolt that secures the hinge to the trunk lid whereby said first bracket is adapted to be coupled to the automobile body without forming any holes therein;

(b) a second bracket having means for mounting the antenna thereon; and (c) pivotable joint means coupling said first and said second brackets to each other whereby with the trunk lid closed and with said first bracket secured to the hinge by means of the bolt, a portion of said second bracket with the antenna mounted thereon will be exposed and whereby after manipulation of said joint means about different first and second axes said second bracket with the antenna mounted thereon will be completely contained within the trunk compartment without removing said first bracket from the hinge.

2. The assembly according to claim 1 wherein said joint means comprises a third bracket pivotally coupled to said first bracket and a fourth bracket pivotally coupled to said third bracket, said second bracket being coupled to said fourth bracket, said fourth bracket being pivotable about said first axis, and said third bracket being pivotable about said second axis.

3. The assembly according to claim 2 wherein said first bracket includes first and second end portions with said first end portion having said opening therein for receiving the hinge bolt, said second end portion of said first bracket being coupled to said third bracket by means of a pivot pin located on said second axis.

4. The assembly according to claim 3 wherein said first bracket includes a stop pin in said second end portions thereof and said third bracket includes an arcuate slot concentric with said second axis for receiving said stop pin and cooperating therewith for limiting the angular movement of said third bracket with respect to said first bracket.

5. The assembly according to claim 4 wherein said first bracket includes means for receiving said stop pin in either of two positions, both of which permit cooperation between said stop pin and said arcuate slot.

6. The assembly according to claim 2 wherein said fourth bracket includes first and second end portions with said first end portion thereof being coupled to said third bracket by means of a pivot pin located on said first axis.

7. The assembly according to claim 6 wherein said third and said fourth brackets include means for receiving said pivot pin in either of two positions.

8. The assembly according to claim 2 wherein said first and said second axes are perpendicular to each other.

9. The assembly according to claim 2 wherein spacer means are further included intermediate said second and said fourth brackets.

10. The assembly according to claim 9 wherein means are included for adjustably securing said second bracket to said spacer means.

11. The assembly according to claim 9 wherein means are included for adjustably securing said fourth bracket to said spacer means.

12. The assembly according to claim 9 wherein a plurality of means are included for variably locating said fourth bracket with respect to said spacer means.

13. The assembly according to claim 1 wherein the axis of said opening in said first bracket is in a vertical plane when said assembly is mounted on the bolt that secures the hinge to the trunk lid.

14. The assembly according to claim 1 wherein the axis of said opening in said first bracket is in a horizontal plane when said assembly is mounted on the bolt that secures the hinge to the trunk lid.

* * * * *